United States Patent [19]

Fisher et al.

[11] Patent Number: 4,538,214

[45] Date of Patent: Aug. 27, 1985

[54] MAGNETICALLY SUPPORTED SURGICAL LIGHT

[75] Inventors: Kenneth J. Fisher; William R. Miller, both of Erie, Pa.

[73] Assignee: American Sterilizer Company, Erie, Pa.

[21] Appl. No.: 566,580

[22] Filed: Dec. 29, 1983

[51] Int. Cl.[3] ..... F21S 1/02

[52] U.S. Cl. ..... 362/147; 362/804; 362/272; 362/398; 362/285; 362/403; 362/404

[58] Field of Search ..... 362/147, 804, 457, 272, 362/398, 285, 404, 403, 430, 253

[56] References Cited

U.S. PATENT DOCUMENTS

| | | | |
|---|---|---|---|
| 2,911,519 | 11/1959 | Phillips et al. | 362/272 |
| 3,010,013 | 11/1961 | Gunther et al | 362/147 |
| 3,240,925 | 3/1966 | Paschke et al. | 362/253 |
| 3,292,579 | 12/1966 | Buchanan | 362/253 |
| 3,360,640 | 12/1967 | Seitz et al. | 362/32 |
| 4,032,775 | 6/1977 | Bobrick et al. | 240/73 R |
| 4,130,858 | 12/1978 | Hayakawa | 362/404 |

FOREIGN PATENT DOCUMENTS

| | | | |
|---|---|---|---|
| 1112023 | 8/1961 | Fed. Rep. of Germany | 362/147 |

*Primary Examiner*—Magdalen Y. C. Moy

*Attorney, Agent, or Firm*—Robert D. Yeager; Christine R. Ethridge

[57] ABSTRACT

An illumination system having a continuous fixed ceiling panel, at least one light source suspended by a telescoping arm from the panel and a split-core transformer formed by two electroinductive coils enclosed in permanent magnets through which a magnetic field is created for the sealed transfer of electrical energy through the panel to the light source. One magnet is disposed on opposite surfaces of the panel. Rollers or a pneumatic system may be disposed between each magnet and the surface of the panel on which the magnet is disposed for sliding the magnets over the surfaces of the panel while maintaining the transfer of electrical energy. Secondary lighting means may also be included.

18 Claims, 4 Drawing Figures

MAGNETICALLY SUPPORTED SURGICAL LIGHT

BACKGROUND OF THE INVENTION

1. Field of the Invention

The present invention relates to ceiling supported illumination systems and more particularly to illumination systems having magnetically coupled split-core transformers.

2. Description of the Prior Art

Conventional ceiling supported lighting systems include track lighting with pivoting and telescoping arms. In surgical suites or other health care facilities where it is usually important to maintain a sterile environment, track lighting systems are thought to be a possible source of contamination because of debris generated from the open electrical communicator design. Bobrick et al. U.S. Pat. Nos. 3,936,671; 4,032,775; and 4,097,919 disclose track lighting systems having a carriage which permits positive and continuous connection between a power source and electrical conductors within the telescoping arm of the light fixture.

The horizontal and vertical adjustment of track lighting systems are limited to the path of the track and pivoting from points along the track. Central pendant mount lighting systems with multiple crossarms cause different position problems due to the mechanical complexity and large inertial loads of the systems.

Duddy U.S. Pat. No. 3,917,940 discloses a magnetic base for a lamp which permits the lamp to be supported by a ferromagnetic attachment surface. Power for the lamp is transferred via conventional means. Buchanan U.S. Pat. No. 3,292,579 discloses an aquarium power supply system which includes two electromagnets supported on the inside and outside of the tank by an adhesive material. Power is transmitted into the tank via the electromagnets. The electromagnets cannot be freely adjusted over the surface of the aquarium.

It is an object of this invention to provide an illumination system which provides a sealed transfer of electrical energy from the power source to the light source and which offers a greater range of horizontal and vertical adjustment of the light source than is offered by conventional systems. It is a further object of the present invention to provide a mechanically simple lighting system.

SUMMARY OF THE INVENTION

The present invention provides an illumination system for use with a conventional power source which includes a continuous panel, preferably a ceiling panel, having an exposed surface and a concealed surface, at least one light source suspended from the panel and at least one means for creating a magnetic field for transferring electrical energy through the panel to each of the light sources. Each of the means for creating a magnetic field is adapted for sliding motion over the panel surfaces while maintaining the transfer of electrical energy. The transfer of electrical energy through the panel is preferably a sealed transfer for use in a generally sterile environment. The illumination systems may also include means, preferably a telescoping member, to move the light source in a direction perpendicular to the panel.

The magnetic field creating means may be a split-core transformer having two halves. One of the halves is disposed on the concealed surface of the panel and is connected to the power source. The other half is disposed on the exposed surface of the panel and is connected, preferably by the telescoping member, to the light source. The halves may be a magnetically coupled mount for the light source. Each of the halves may be an electroinductive coil enclosed in a permanent magnet. Each magnet may have rollers on which the magnet can slide over the surface of the panel on which it is disposed. Alternatively, each magnet may be so pneumatically separated from the panel that each of the magnets can slide over the surface on which it is disposed.

The illumination system may include a plurality of secondary lighting means in relation to the panel.

BRIEF DESCRIPTION OF THE DRAWINGS

The following detailed description of the preferred embodiment can better be understood if reference is made to the drawings in which.

DETAILED DESCRIPTION OF THE PREFERRED EMBODIMENTS

Figure 1:
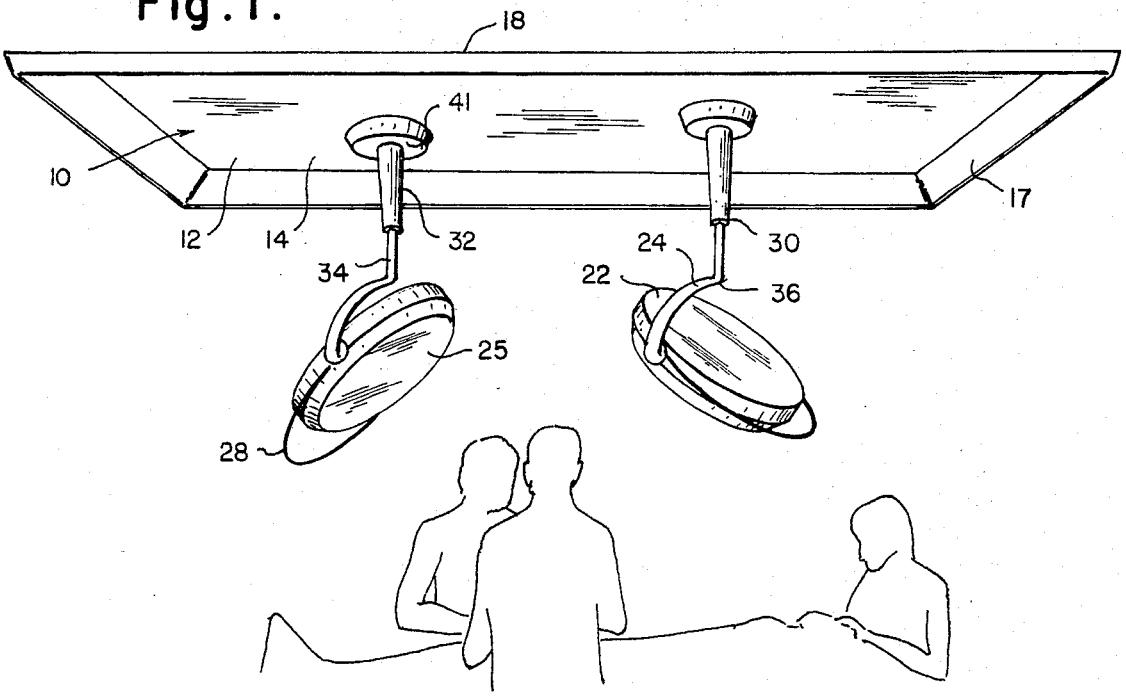
FIG. 1 is a perspective view of the light suspended from the panel.
Figure 2:
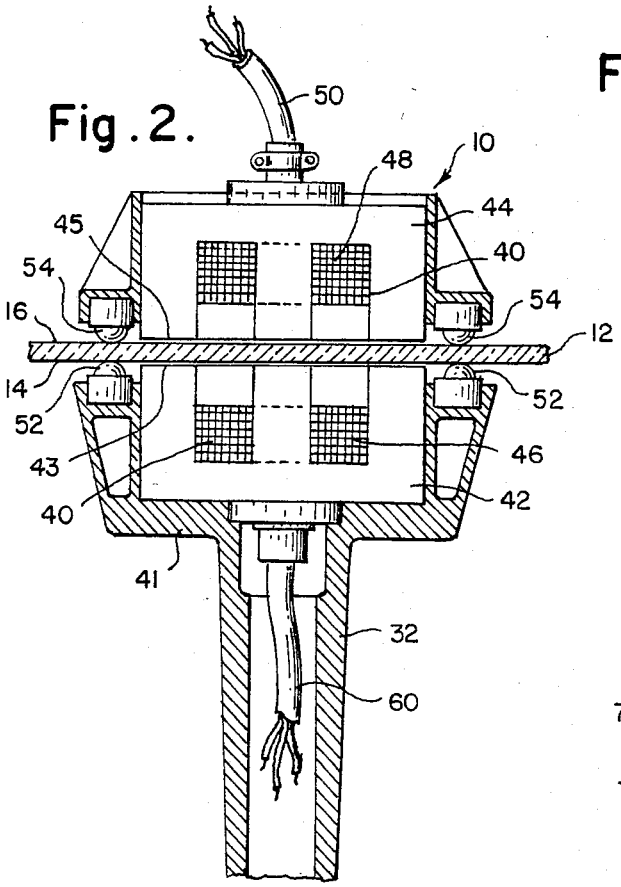
FIG. 2 is a cross section view of the magnetically coupled split core transformer having rollers as sliding means.
Figure 3:
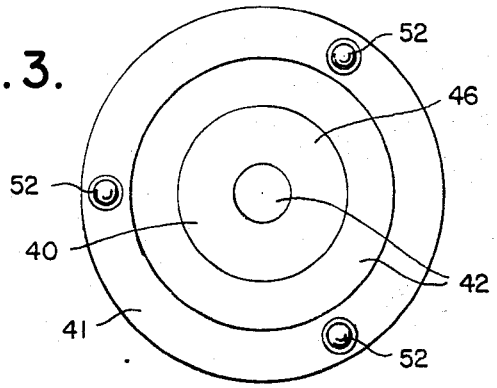
FIG. 3 is a plan view of one-half of the device of FIG. 2.

FIGS. 1 through 3 illustrate the preferred embodiment of the present invention. The illumination system 10 is particularly well adapted for use in surgical suites or similar sterile environments. The illumination system 10 includes ceiling panel 12, light source 20, arm 30 and splitcore transformer 40.

Referring to FIGS. 1 and 2 ceiling panel 12 includes an exposed surface 14, a concealed surface 16, periphery 18 and pheripheral enclosure 17 for housing secondary lighting (not shown). The panel 12 has continuous smooth surfaces 14 and 16 made of any suitable nonmagnetic material. Although panel 12 is preferably fixed to the ceiling of a surgical suite, it can be appreciated that in other settings it may be preferable to fix panel 12 to a wall. In the preferred setting, it is important that the periphery 18 of panel 12 be sufficiently sealed to prevent debris from entering the sterile environment.

Light source 20 includes housing 22, bracket 24, adjustment handle 28 and lamp face 25. Bracket 24 is connected to housing 22 at pivot point 26 by any suitable known means. Housing 12 is preferably made of a lightweight heat resistant plastic and may include one or several lamp faces 25. Bracket 24 is connected to arm 30 at end 36 of bracket 24. If the point of connection to arm 30 is such that the center of gravity of housing 22 of light source 20 is in line with arm 30, undesirable moments with respect to the magnetic suspension are reduced. Housing 22 may assume a variety of shapes and accommodate a variety of lamp faces 25 without exceeding the scope of the claimed invention.

Arm 30 is preferably a telescoping member having an upper sleeve 32 and a lower cylinder 34 which is concentric to, and slides vertically within, upper sleeve 32. Cylinder 34 is connected to the end 36 of bracket 24 in any suitable fashion. Cylinder 34 may be integral to bracket 24. Sleeve 32, cylinder 34 and bracket 24 should be hollow so that lines 60 for transferring electrical current from the split-core Transformer 40 to the light source 20 can be disposed therein. Upper sleeve 32 is connected in any suitable fashion, preferably integrally, to mount 41.

Split core transformer 40 includes two halves. Referring to FIG. 2, the upper half of transformer 40 is disposed on concealed surface 16 of panel 12 and includes electroinductive coil 48. The lower half of transformer 40 is disposed on exposed surface 14 of panel 12 and includes electroinductive coil 46. Power lines 50 connect the upper half of transformer 40 to a conventional power source (not shown).

Split-core transformer 40 is magnetically coupled via strong permanent magnets 42 and 44. Magnet 42 encloses the lower half of transformer 40 which includes electroinductive coil 46. Mount 41 encases magnet 42. Magnet 44 encloses the upper half of transformer 40 which includes electroinductive coil 48. Magnets 42 and 44 operate as magnetic circuits.

Electrical energy from the power source is transferred through power lines 50 to transformer 40. A magnetic field is created between electroinductive coils 46 and 48 and magnetic circuits 42 and 44 for transferring the electrical energy from coil 48 through panel 12 to coil 46 and through lines 60 in sleeve 32, cylinder 34 and brackets 24 to housing 22 of light source 20. The slit-core arrangement of the transformer 40 and the magnetically coupled mounting via magnetic circuits 42 and 44 permit a sealed transfer of electricl energy through panel 12 to the light source 20 so that the sterile environment of the surgical suite is maintained.

The light source 20 may be moved horizontally anywhere along panel 12 while maintaining an uninterrupted transfer of electrical energy by sliding the magnetically coupled split-core transformer 40 over the surfaces 14 and 16 of panel 12. In one embodiment, as illustrated in FIGS. 2 and 3, mechanical rollers in the form of three miniature rotating casters 52 may be placed near a surface 43 of magnetic circuit 42 which faces exposed surface 14 of panel 12 and three such casters 54 may be placed on a surface 45 of magnet 44 which faces concealed surface 16 of panel 12. The casters 52 and 54 should self-align in any direction to provide best results.

Figure 4:
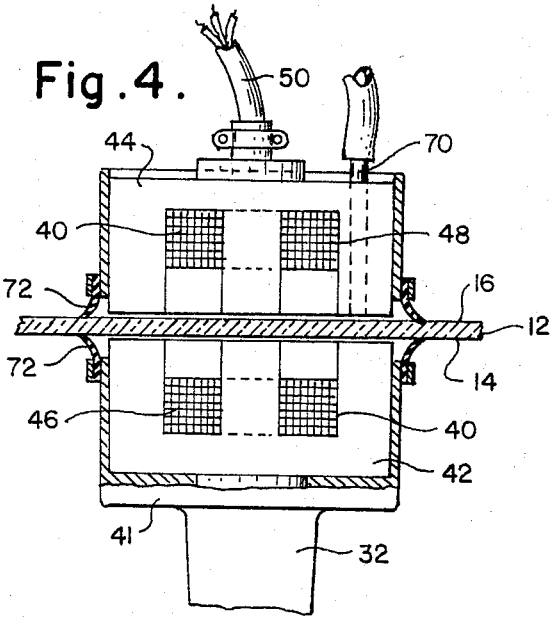
FIG. 4 is a cross section view of the magnetically coupled split core transformer having pneumatic sliding means.

In another embodiment, as illustrated in FIG. 4, pneumatic separation of magnetic circuits 42 and 44 from surfaces 14 and 16, respectively, can facilitate the desired horizontal sliding motion over surfaces 14 and 16. An air bearing system 70 may be placed in magnetic circuits 42 and 44. Magnetic coupling of the transformer 40 is maintained through the spaces which separate magnetic circuit 42 from exposed surface 14 and magnetic circuit 44 from concealed surface 16. The magnetic field for transferring electrical energy can be similarly maintained. Skirts 72 glide over surfaces 14 and 16 to enclose the spaces which separate magnetic circuits 42 and 44 from their respective surfaces 14 and 16.

By manipulating the adjustment handle 28 of light source 20, the light source 20 can be moved horizontally over panel 12 and vertically via telescoping arm 30. Additionally, the light source 20 may be pivoted about pivot point 26 of bracket 24. One or more light sources 20 may be suspended from panel 12. The freedom of movement available to each light source 20 together with the secondary lighting in the peripheral enclosure 17 of panel 12 offers a wide range of lighting possibilities.

Secondary transformers (not shown) may also be placed behind panel 12 for controlling additional lighting or auxiliary equipment, thus removing the bulky items from their conventional position on wall mounted control units.

What is claimed is:

1. An illumination system suspended from a continuous panel having an exposed surface and a concealed surface for use with a conventional power source comprising:

at least one light source suspended from the panel;

at least one split-core transformer for creating a magnetic field for transferring electrical energy through the panel to said light source, each said transformer adapted for sliding motion over the exposed and concealed surfaces while maintaining said transfer of electrical energy, each said transformer having two halves, one of said halves disposed on the concealed surface and connected to the power source and the other of said halves disposed on the exposed surface and connected to said light source; and each of said halves comprising electroinductive coils enclosed in permanent magnets, each of said magnets having rollers on which said magnet can slide over the one of the surfaces on which said magnet is disposed.

2. An illumination system as recited in claim 1 further comprising means to move said light source in a direction perpendicular to the panel.

3. An illumination system as recited in claim 2 wherein said perpendicular light moving means is a telescoping member connecting said light source to said transformer.

4. An illumination system as recited in claim 1 wherein the panel is a fixed ceiling panel.

5. An illumination system as recited in claim 1 further comprising a plurality of secondary lighting means in relation to the panel.

6. An illumination system suspended from a continuous panel having an exposed surface and a concealed surface for use with a conventional power source comprising:

at least one light source suspended from the panel;

at least one split-core transformer for creating a magnetic field for transferring electrical energy through the panel to said light source, each said transformer adapted for sliding motion over the exposed and concealed surfaces while maintaining said transfer of electrical energy, each said transformer having two halves, one of said halves disposed on the concealed surface and connected to the power source and the other of said halves disposed on the exposed surface and connected to said light source; and each of said halves comprising electroinductive coils enclosed in permanent magnets, the one of said halves disposed on the concealed surface being so pneumatically separated from the panel that each of said magnets can slide over the one of the surfaces on which said magnet is disposed.

7. An illumination system as recited in claim 6 further comprising means to move said light source in a direction perpendicular to the panel.

8. An illumination system as recited in claim 7 wherein said perpendicular light moving means is a telescoping member connecting said light source to said transformer.

9. An illumination system as recited in claim 6 wherein the panel is a fixed ceiling panel.

10. An illumination system as recited in claim 6 further comprising a plurality of secondary lighting means in relation to the panel.

11. An illumination system for use with a conventional power source comprising:

a continuous panel having an exposed surface and a concealed surface;

at least one light source suspended from said panel, said light source adapted for movement in a direction perpendicular to said panel;

at least one split-core transformer for transferring electrical energy through said panel to at least one of said light sources, said transformer adapted for sliding motion over said exposed and concealed surfaces while maintaining said transfer of electrical energy.

12. An illumination system as recited in claim 11 wherein each of said split-core transformers comprises two electroinductive coils enclosed in permanent magnets, one of said magnets being disposed on said concealed surface and connected to the power source and the other of said magnets being disposed on said exposed surface and connected to at least one of said light sources.

13. A ceiling illumination system for use with a conventional power source in a generally sterile environment having a ceiling comprising:

a continuous panel fixed in the ceiling of the sterile environment;

at least one light source suspended from said panel;

at least one magnetically coupled mount for said light source for providing a sealed transfer of electrical energy through said panel to said light source, each of said mounts adapted for sliding motion over said panel while maintaining said sealed transfer of electrical energy, said mount having two halves, each of said halves being so disposed on opposite sides of said panel that a magnetic field is created therebetween for transferring electrical energy through said panel to said light source; and each of said halves having rollers on which said half can slide over the side of said panel on which said half is disposed.

14. A ceiling illumination system as recited in claim 13 wherein said halves are electroinductive coils enclosed in permanent magnets which together form a slit-core transformer.

15. A ceiling illumination system as recited in claim 13 further comprising:

a telescoping member disposed between said light source and said mount for raising and lowering said light source; and a plurality of secondary lighting means disposed on said panel.

16. A ceiling illumination system for use with a conventional power source in a generally sterile environment having a ceiling comprising:

a continuous panel fixed in the ceiling of the sterile environment;

at least one light source suspended from said panel;

at least one magnetically coupled mount for said light source for providing a sealed transfer of electrical energy through said panel to said light source, each of said mounts adapted for sliding motion over said panel while maintaining said sealed transfer of electrical energy, said mount having two halves, each of said halves being so disposed on opposite sides of each said panel that a magnetic field is created therebetween for transferring electrical energy through said panel to said light source; and one of said halves being so pneumatically separated from said panel that each of said halves can slide over the side of said panel on which said half is disposed.

17. A ceiling illumination system as recited in claim 16 wherein said halves are electroinductive coils enclosed in permanent magnets which together form a split-core transformer.

18. A ceiling illumination system as recited in claim 16 further comprising:

a telescoping member disposed between said light source and said mount for raising and lowering said light source; and a plurality of secondary lighting means disposed on said panel.

* * * * *

UNITED STATES PATENT AND TRADEMARK OFFICE

CERTIFICATE OF CORRECTION

PATENT NO. : 4,538,214

DATED : August 27, 1985

INVENTOR(S) : Kenneth J. Fisher and William R. Miller

It is certified that error appears in the above—identified patent and that said Letters Patent is hereby corrected as shown below:

Col. 2, line 39, delete "splitcore" and substitute therefor --split-core--;

Col. 3, line 30, delete "slit-core and substitute therefor --split-core--;

Col. 3, line 32, delete "electricl" and substitute therefor --electrical--;

Col. 6, line 7, delete "slit-core" and substitute therefor --split-core--.

Signed and Sealed this

*Seventh* Day of *January 1986*

[SEAL]

*Attest:*

DONALD J. QUIGG

*Attesting Officer*

*Commissioner of Patents and Trademarks*